US010529172B2

(12) United States Patent
Hendricks et al.

(10) Patent No.: US 10,529,172 B2
(45) **Date of Patent: *Jan. 7, 2020**

(54) GAMING MACHINES AND METHODS OF GAMING PROVIDING ENHANCED PRESENTATION OF AN EXPANDABLE SYMBOL

(71) Applicant: Aristocrat Technologies Australia Pty Limited, North Ryde (AU)

(72) Inventors: Bradley John Hendricks, Las Vegas, NV (US); Damien Burczyk, Henderson, NV (US); Todd Jeremy Hritz, Las Vegas, NV (US)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/194,011

(22) Filed: Nov. 16, 2018

(65) Prior Publication Data

US 2019/0088078 A1 Mar. 21, 2019

Related U.S. Application Data

(63) Continuation of application No. 14/869,421, filed on Sep. 29, 2015, now Pat. No. 10,157,516.

(30) Foreign Application Priority Data

Sep. 29, 2014 (AU) ..... 2014903917

(51) Int. Cl.
*G07F 17/00* (2006.01)
*G07F 19/00* (2006.01)
*G07F 17/32* (2006.01)
*G07F 17/34* (2006.01)

(52) U.S. Cl.
CPC ..... *G07F 17/3213* (2013.01); *G07F 17/32* (2013.01); *G07F 17/3216* (2013.01); *G07F 17/3267* (2013.01); *G07F 17/34* (2013.01)

(58) Field of Classification Search
CPC .... G07F 17/32; G07F 17/3213; G07F 17/326; G07F 17/3262; G07F 17/3267; G07F 17/34
See application file for complete search history.

(56) References Cited

U.S. PATENT DOCUMENTS

| | | | |
|---|---|---|---|
| 6,375,570 | B1 | 4/2002 | Poole |
| 6,439,993 | B1 | 8/2002 | O'Halloran |
| 6,585,264 | B2 | 7/2003 | Benett |
| 6,896,615 | B2 | 5/2005 | Berman |
| 8,337,293 | B2 | 12/2012 | Fong et al. |

(Continued)

OTHER PUBLICATIONS

Examination Report No. 1 for standard patent application for Australian Application No. 2017203301, dated Dec. 14, 2017, pp. 1-3.

*Primary Examiner* — Milap Shah
(74) *Attorney, Agent, or Firm* — McAndrews, Held & Malloy, Ltd.

(57) ABSTRACT

The present invention relates to a gaming machine, methods of gaming systems. In particular, a gaming machine which provides a spinning reel game of chance is provided. Certain symbols are controlled to expand to cover other symbols of virtual spinning reels, in order to provide the player with a dynamic visual game appearance.

20 Claims, 10 Drawing Sheets

(56) References Cited

U.S. PATENT DOCUMENTS

| | | | | |
|---|---|---|---|---|
| 8,512,127 | B2 | 8/2013 | Jaffe et al. | |
| 8,734,223 | B2 | 5/2014 | Zoble et al. | |
| 8,834,258 | B2 | 9/2014 | Gobe et al. | |
| 9,495,839 | B2 | 11/2016 | Aoki et al. | |
| 9,552,704 | B2 | 1/2017 | Poole et al. | |
| 9,666,020 | B2 | 5/2017 | Gobe et al. | |
| 9,773,384 | B2 * | 9/2017 | Nauman | G07F 17/34 |
| 10,157,516 | B2 * | 12/2018 | Hendricks | G07F 17/32 |
| 2003/0207709 | A1 * | 11/2003 | Paotrakul | G07F 17/3244 463/20 |
| 2004/0048646 | A1 | 3/2004 | Visocnik | |
| 2005/0049030 | A1 | 3/2005 | Tachikawa | |
| 2005/0130731 | A1 * | 6/2005 | Englman | G07F 17/32 463/20 |
| 2006/0068881 | A1 * | 3/2006 | Casey | G07F 17/3265 463/20 |
| 2007/0026933 | A1 | 2/2007 | Tanimura | |
| 2007/0060245 | A1 | 3/2007 | Veenker | |
| 2007/0060261 | A1 | 3/2007 | Gomez | |
| 2008/0032784 | A1 * | 2/2008 | Englman | G07F 17/3265 463/21 |
| 2008/0108411 | A1 | 5/2008 | Jensen et al. | |
| 2008/0132322 | A1 | 6/2008 | Yoshizawa | |
| 2008/0146319 | A1 | 6/2008 | Yoshizawa | |
| 2008/0188280 | A1 | 8/2008 | Marks | |
| 2008/0188286 | A1 | 8/2008 | Jaffe | |
| 2009/0233685 | A1 * | 9/2009 | Nguyen | G07F 17/3265 463/20 |
| 2009/0253488 | A1 | 10/2009 | Yoshizawa | |
| 2009/0286588 | A1 | 11/2009 | Jackson | |
| 2011/0201406 | A1 | 8/2011 | Jaffe et al. | |
| 2011/0223985 | A1 | 9/2011 | Mizue et al. | |
| 2014/0274288 | A1 | 9/2014 | Hornik et al. | |
| 2015/0011291 | A1 | 1/2015 | Nauman | |
| 2015/0348363 | A1 | 12/2015 | Johnson et al. | |

* cited by examiner

GAMING MACHINES AND METHODS OF GAMING PROVIDING ENHANCED PRESENTATION OF AN EXPANDABLE SYMBOL

RELATED APPLICATIONS

The present application is a continuation of U.S. patent application Ser. No. 14/869,421, filed Sep. 29, 2015, which claims priority to Australia Provisional Patent Application No. 2014903917, having a filing date of Sep. 29, 2014. Each of the above-mentioned applications are hereby incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

While gaming equipment provides players with enjoyment, a need exists for alternative gaming equipment in order to maintain or increase player enjoyment. Accordingly, offering a range of different and unique spinning reel games of chance in slot machines can assist in maintaining and increasing player enjoyment. Gaming equipment, such as a slot machine, incorporating an embodiment(s) of the present invention can offer a spinning reel game of chance in which certain symbols are capable of expanding to thereby provide the player with a dynamic visual game appearance.

BRIEF SUMMARY OF THE INVENTION

According to a first aspect there is provided a gaming machine comprising an electronic game controller and a display, the electronic game controller being arranged to cause a plurality of discrete symbols to be displayed on the display, wherein at least a first of the discrete symbols is displayed at a location that is lateral to at least a second of the discrete symbols, the first of the discrete symbols being such that it can expand in size to obscure the second of the discrete symbols.

According to a second aspect there is provided a gaming machine comprising a game controller and a display, the game controller being arranged to determine an outcome for a game of chance and visually depict the outcome on the display, the game controller is arranged to depict the outcome on the display by simulating a plurality of spinning reels, each of the reels is associated with a plurality of symbols, wherein at least one of the reels comprises a special symbol, the special symbol being such that it can expand in size to obscure at least one of the symbols associated with at least one of the reels that is laterally located adjacent the special symbol.

According to a third aspect there is provided a gaming machine comprising a game controller that is arranged to facilitate play of a game of chance, the game controller being arranged such that it makes a selection of a plurality of symbols and will award an award to a player of the gaming machine if the plurality of symbols corresponds to a winning symbol combination, wherein the game controller is such that if the plurality of symbols comprises a predefined expanding symbol the game controller makes a change to the plurality of symbols, the game controller is arranged to depict the change to the plurality of symbols on a display by causing an image of the predefined expanding symbol to expand laterally so as to replace an adjacent one of the plurality of symbols.

According to a fourth aspect there is provided a gaming system comprising a game server and a computing device that is remote to the game server, the game server and the computing device being arranged to interact with each other via a data network, the game server being arranged to cause a plurality of discrete symbols to be displayed on a display of the computing device, wherein at least a first of the discrete symbols is displayed at a location that is lateral to at least a second of the discrete symbols, the first of the discrete symbols being such that it can expand in size to obscure the second of the discrete symbols.

According to a fifth aspect there is provided a gaming system comprising a game server and a computing device that is remote to the game server, the game server and the computing device being arranged to interact with each other via a data network, the game server being arranged to determine an outcome for a game of chance and visually depict the outcome on a display of the computing device, the game server is arranged to depict the outcome on the display by simulating a plurality of spinning reels, each of the reels is associated with a plurality of symbols, wherein at least one of the reels comprises a special symbol, the special symbol being such that it can expand in size to obscure at least one of the symbols associated with at least one of the reels that is laterally located adjacent the special symbol.

According to a sixth aspect there is provided a gaming system comprising a game server and a computing device that is remote to the game server, the game server and the computing device being arranged to interact with each other via a data network, the game server being arranged such that it makes a selection of a plurality of symbols and will award an award to a player of the gaming machine if the plurality of symbols corresponds to a winning symbol combination, wherein the game server is such that if the plurality of symbols comprises a predefined expanding symbol the game server makes a change to the plurality of symbols, the game controller is arranged to depict the change to the plurality of symbols on a display by causing an image of the predefined expanding symbol to expand laterally so as to replace an adjacent one of the plurality of symbols.

According to a seventh aspect there is provided a method for use with a gaming machine comprising an electronic game controller and a display, the method comprising the steps of: the electronic game controller causing a plurality of discrete symbols to be displayed on the display, wherein at least a first of the discrete symbols is displayed at a location that is lateral to at least a second of the discrete symbols; and the electronic game controller causing the first of the discrete symbols to expand in size so as to obscure the second of the discrete symbols.

According to an eighth aspect there is provided a method for use with a gaming machine comprising a game controller and a display, the method comprising the steps of: the game controller determining an outcome for a game of chance; the game controller visually depicting the outcome on the display such that the outcome is depicted by simulating a plurality of spinning reels, each of the reels is associated with a plurality of symbols, wherein at least one of the reels comprises a special symbol; and the game controller depicting the special symbol such that it expands in size to obscure at least one of the symbols associated with at least one of the reels that is laterally located adjacent the special symbol.

According to a ninth aspect there is provided a method for use with a gaming machine comprising a game controller, the method comprising the steps of the game controller facilitating play of a game of chance; the game controller making a selection of a plurality of symbols; the game controller awarding an award to a player of the gaming machine if the plurality of symbols corresponds to a winning symbol combination; the game controller making a change to the plurality of symbols if the plurality of symbols comprises a predefined expanding symbol, and the game controller depicting the change to the plurality of symbols on a display by causing an image of the predefined expanding symbol to expand laterally so as to replace an adjacent one of the plurality of symbols.

In a tenth aspect, the invention provides computer program code which when executed implements the above method.

In an eleventh aspect, the invention provides a tangible computer readable medium comprising the above program code.

In a twelfth aspect, the invention provides a data signal comprising the above program code.

According to yet another aspect, there is provided a gaming system comprising a game server that is arranged to interact with a remote computing device via a data network, the game server being arranged to cause a plurality of discrete symbols to be displayed on a display of the computing device, wherein at least a first of the discrete symbols is displayed at a location that is lateral to at least a second of the discrete symbols, the first of the discrete symbols being such that it can expand in size to obscure the second of the discrete symbols.

The discrete symbols may be displayed on the display in a matrix arrangement comprising x rows and y columns of the discrete symbols. The first of the discrete symbols may be positioned in a predetermined one of the columns while the second of the discrete symbols may be positioned in an adjacent one of the columns that may be adjacent the predetermined one of the columns. The first of the discrete symbols may be such that as a result of expanding in size it is positioned in at least the predetermined column and the adjacent column.

The adjacent column may be located on a left side or a right side of the predetermined column.

The first of the discrete symbols may be positioned in at least two of the rows, and as a result of expanding in size the first of the discrete symbols may be positioned in at least two of the rows and at least two of the columns.

The first of the discrete symbols may be caused to expand in size in response to the game controller determining that a predefined trigger event has occurred.

The first of the discrete symbols may be one of a plurality of different symbols that can expand in size.

As a result of the first of the discrete symbols expanding in size, the gaming machine awards an award to a player of the gaming machine.

According to yet another aspect, there is provided a gaming system comprising a game server to interact with a remote computing device via a data network. The game server may determine an outcome for a game of chance and visually depict the outcome on a display of the computing device. The game server may depict the outcome on the display by simulating a plurality of spinning reels, and each of the reels is associated with a plurality of symbols. At least one of the reels may comprise a special symbol, the special symbol being such that it can expand in size to obscure at least one of the symbols associated with at least one of the reels that is laterally located adjacent the special symbol.

The special symbol is such that it occupies at least two symbol positions on the associated reel and the at least one of the symbols associated with at least one of the reels laterally located adjacent the special symbol is one of a plurality of the symbols that is obscured as a result of the special symbol expanding in size.

The at least one of the reels that may be laterally located adjacent the oversized symbol is located on a left side or a right side of the oversized symbol.

As a result of the oversized symbol expanding in size, the gaming machine may award an award to a player of the gaming machine.

The oversized symbol may be caused to expand in size in response to the game controller determining that a predefined trigger event has occurred.

The oversized symbol may be one of a plurality of different oversized symbols that can expand in size.

According to yet another aspect, there is provided a gaming system comprising a game server to interact with a remote computing device via a data network. The game server makes a selection of a plurality of symbols and will award an award to a player of the gaming machine if the plurality of symbols corresponds to a winning symbol combination. The game server may be such that if the plurality of symbols comprises a predefined expanding symbol, the game server makes a change to the plurality of symbols. The game controller may depict the change to the plurality of symbols on a display by causing an image of the predefined expanding symbol to expand laterally so as to replace an adjacent one of the plurality of symbols.

The adjacent one of the plurality of symbols may be located on a left side or a right side of the predefined expanding symbol.

The plurality of symbols may be depicted on the display as being associated with a plurality of spinning reels. The predefined expanding symbol may be depicted on the display as initially being located on only one of the spinning reels and subsequent to expanding laterally the predefined expanding symbol is located on at least two of the spinning reels.

The predefined expanding symbol may occupy at least two symbol positions on each of the at least two of the spinning reels.

The change to the plurality of symbols corresponds to the winning symbol combination.

The change to the plurality of symbols occurs in response to the game controller detecting a game event.

According to yet another aspect, there is provided a method for use with a gaming machine that comprises an electronic game controller and a display. The method comprises the electronic game controller causing a plurality of discrete symbols to be displayed on the display. At least a first of the discrete symbols may be displayed at a location that is lateral to at least a second of the discrete symbols. The method also comprises the electronic game controller causing the first of the discrete symbols to expand in size so as to obscure the second of the discrete symbols.

The discrete symbols may be displayed on the display in a matrix arrangement comprising x rows and y columns of the discrete symbols. The first of the discrete symbols is positioned in a predetermined one of the columns while the second of the discrete symbols is positioned in an adjacent one of the columns that is adjacent the predetermined one of the columns. The first of the discrete symbols may such that as a result of expanding in size it is positioned in at least the predetermined column and the adjacent column.

The adjacent column may be located on a left side or a right side of the predetermined column.

The first of the discrete symbols may be positioned in at least two of the rows. As a result of expanding in size, the first of the discrete symbols may be positioned in at least two of the rows and at least two of the columns.

The first of the discrete symbols may be caused to expand in size in response to the game controller determining that a predefined trigger event has occurred.

The first of the discrete symbols may be one of a plurality of different symbols that can expand in size.

As a result of the first of the discrete symbols expanding in size, the gaming machine may award an award to a player of the gaming machine.

According to still another aspect, there is provided a method for use with a gaming machine comprising a game controller and a display. The method comprises the game controller determining an outcome for a game of chance; the game controller visually depicting the outcome on the display such that the outcome is depicted by simulating a plurality of spinning reels. Each of the reels is associated with a plurality of symbols, wherein at least one of the reels comprises a special symbol. The method also comprises the game controller depicting the special symbol such that it expands in size to obscure at least one of the symbols associated with at least one of the reels that is laterally located adjacent the special symbol.

The special symbol may be such that it occupies at least two symbol positions on the associated reel and the at least one of the symbols associated with at least one of the reels laterally located adjacent the special symbol is one of a plurality of the symbols that is obscured as a result of the special symbol expanding in size.

The at least one of the reels that may be laterally located adjacent the oversized symbol is located on a left side or a right side of the oversized symbol.

As a result of the oversized symbol expanding in size, the gaming machine may award an award to a player of the gaming machine.

The oversized symbol may be caused to expand in size in response to the game controller determining that a predefined trigger event has occurred.

The oversized symbol may be one of a plurality of different oversized symbols that can expand in size.

According to still another aspect, there is provided a method for use with a gaming machine comprising a game controller. The method comprises the game controller facilitating play of a game of chance, the game controller making a selection of a plurality of symbols, the game controller awarding an award to a player of the gaming machine if the plurality of symbols corresponds to a winning symbol combination; the game controller making a change to the plurality of symbols if the plurality of symbols comprises a predefined expanding symbol, and the game controller depicting the change to the plurality of symbols on a display by causing an image of the predefined expanding symbol to expand laterally so as to replace an adjacent one of the plurality of symbols.

The adjacent one of the plurality of symbols According to still another aspect, there is provided a located on a left side or a right side of the predefined expanding symbol.

The plurality of symbols may be depicted on the display as being associated with a plurality of spinning reels. The predefined expanding symbol is depicted on the display as initially being located on only one of the spinning reels and subsequent to expanding laterally the predefined expanding symbol is located on at least two of the spinning reels.

The predefined expanding symbol occupies at least two symbol positions on each of the at least two of the spinning reels.

The change to the plurality of symbols corresponds to the winning symbol combination.

The change to the plurality of symbols occurs in response to the game controller detecting a game event.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
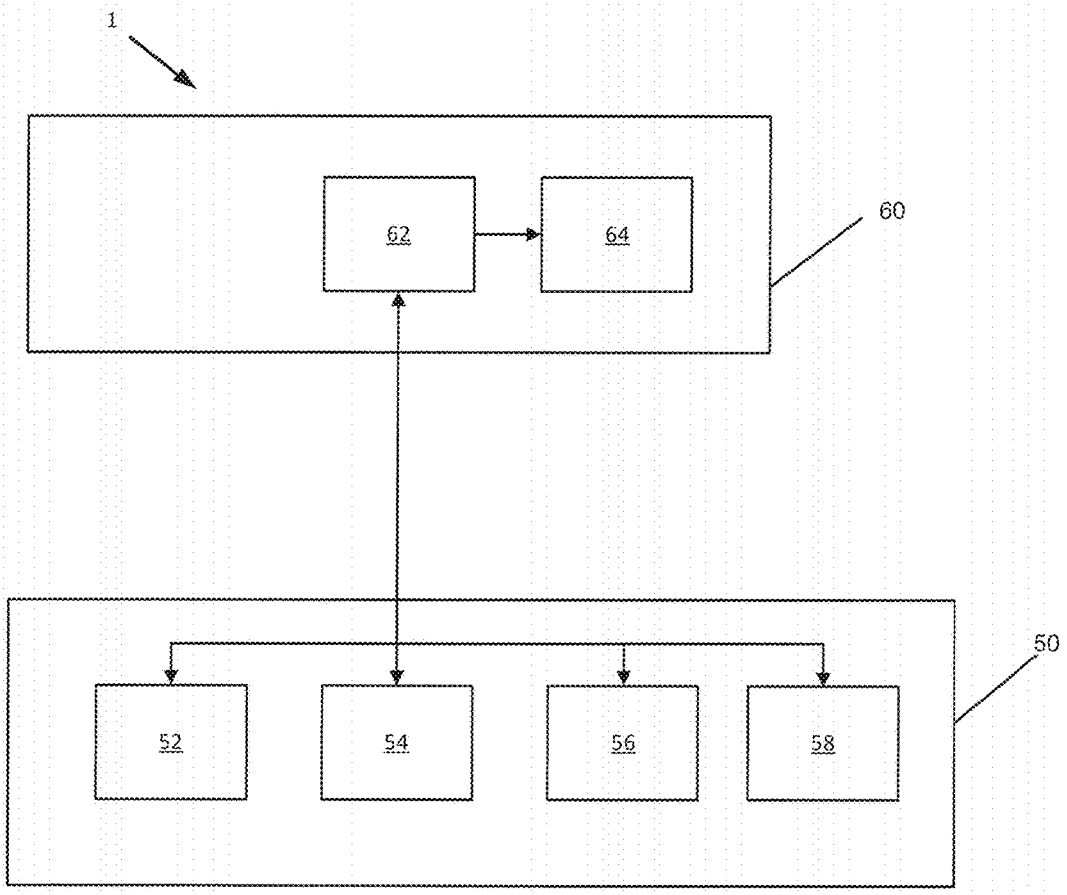
FIG. 1 is a block diagram of the core components of a gaming system.

Referring to the drawings, there is shown gaming equipment having a game controller arranged to implement a spinning reel game of chance (commonly referred to a slot machine or pokie machine). The spinning reel game incorporates certain symbols that are capable of expanding in size to thereby provide players with a dynamic visual appearance.

General Construction of Gaming Equipment

The gaming equipment can take a number of different forms. In a first form, a stand alone gaming machine is provided wherein all or most components required for implementing the game are present in a player operable gaming machine.

In a second form, a distributed architecture (such as an online gaming system) is provided wherein some of the components required for implementing the game are present in a player operable gaming machine, or a general purpose computing device such as a laptop or smart phone, and some of the components required for implementing the game are located remotely relative to the gaming machine in a game server. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, gaming equipment has several core components. At the broadest level, the core components of the equipment 1 are a player interface 50 and a game controller 60 as illustrated in FIG. 1. The player interface 50 is arranged to enable manual interaction between a player and the gaming equipment 1 and for this purpose includes the input/output components required for the player to enter instructions to play the game and observe the game outcomes.

Components of the player interface 50 may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface 50 and typically includes a microprocessor 62 that processes the game play instructions in accordance with game play rules and outputs game play outcomes to the display 54. Typically, the game play rules are stored as program code in a memory 64 but can also be hardwired. Herein the term "microprocessor" or "processor" is used to refer generically to any device that can process game play instructions in accordance with game play rules and may include: a microprocessor, microcontroller, programmable logic device or other computational device, a general purpose computer (e.g. a PC) or a server. That is a processor 62 may be provided by any suitable logic circuitry for receiving inputs, processing them in accordance with instructions stored in memory and generating outputs (for example on the display). Such processors 62 are sometimes also referred to as central processing units (CPUs). Most processors 62 are general purpose units, however, it is also known to provide a specific purpose processor 62 using an application specific integrated circuit (ASIC) or a field programmable gate array (FPGA).

Figure 2:
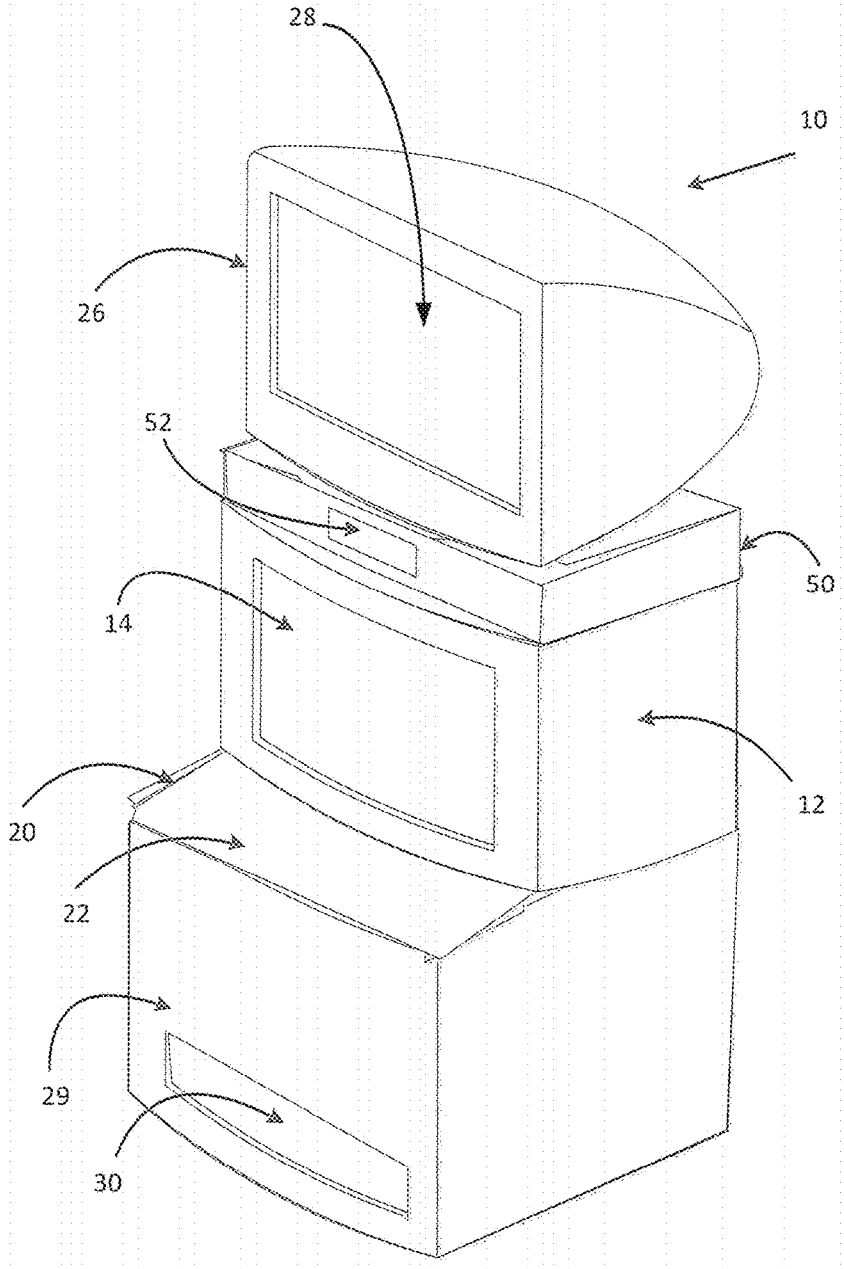
FIG. 2 is a perspective view of a stand alone gaming machine.

Gaming equipment in the form of a stand alone gaming machine 10 is illustrated in FIG. 2. The gaming machine 10 includes a console 12 having a display 14 on which are displayed representations of a game that can be played by a player. A mid-trim 20 of the gaming machine 10 houses a bank of buttons 22 for enabling a player to interact with the gaming machine 10, in particular during game play. The mid-trim 20 also houses a credit input mechanism (not shown in the figures) which in this example includes a coin input chute and a bill collector. Other credit input mechanisms may also be employed, for example, a card reader for reading a smart card, debit card or credit card. Other gaming machines can be configured for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display 28, for example a video display unit, which may be of the same type as the display 14, or of a different type.

Figure 3:
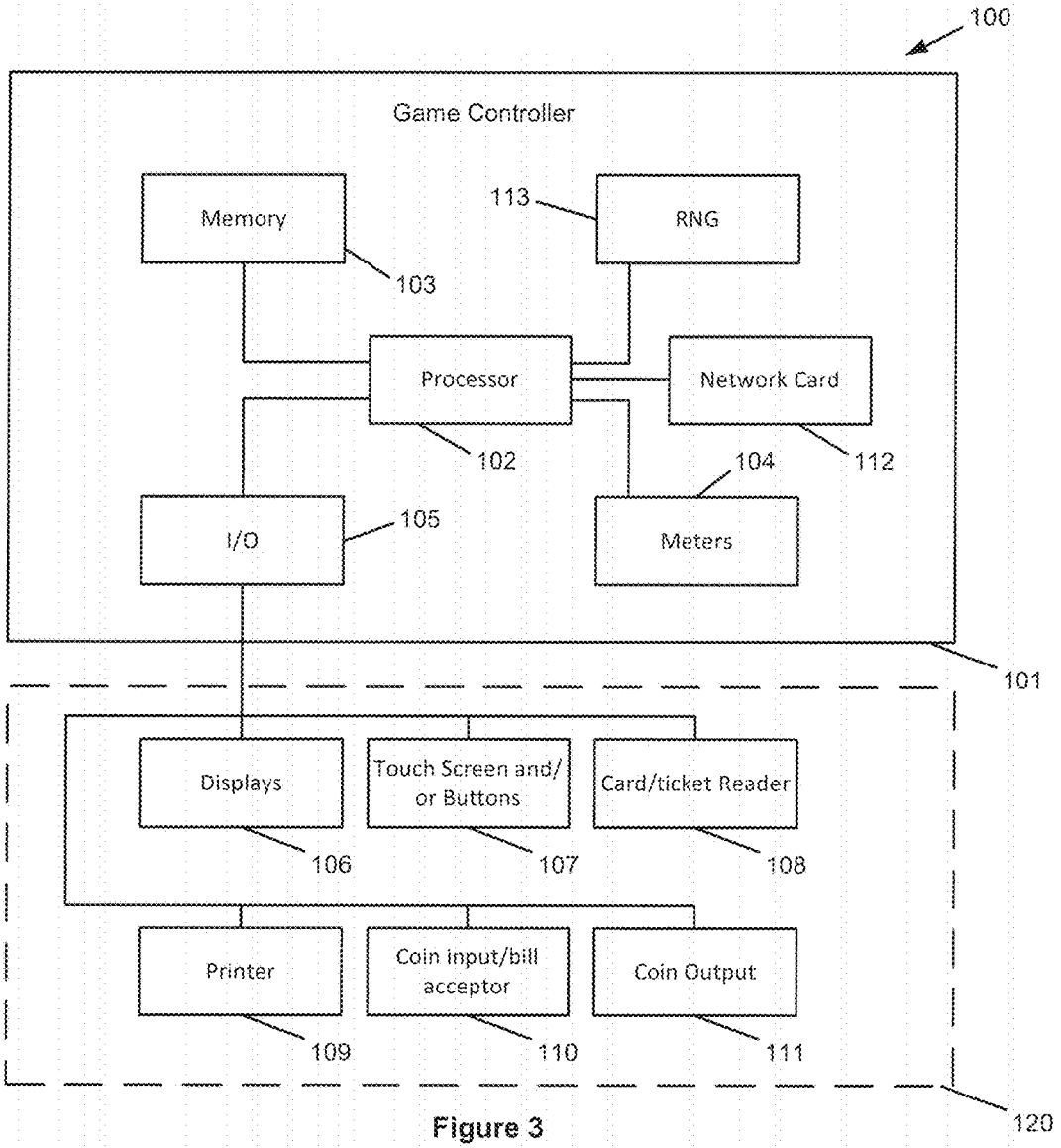
FIG. 3 is a block diagram of the functional components of a gaming machine.

FIG. 3 shows a block diagram of operative components of a typical gaming machine which may be the same as or different to the gaming machine 10 of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine 100 has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
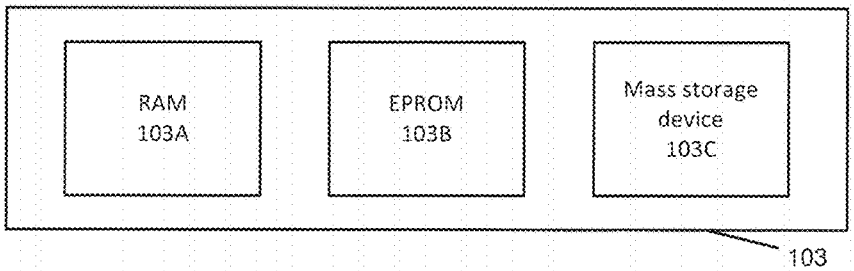
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
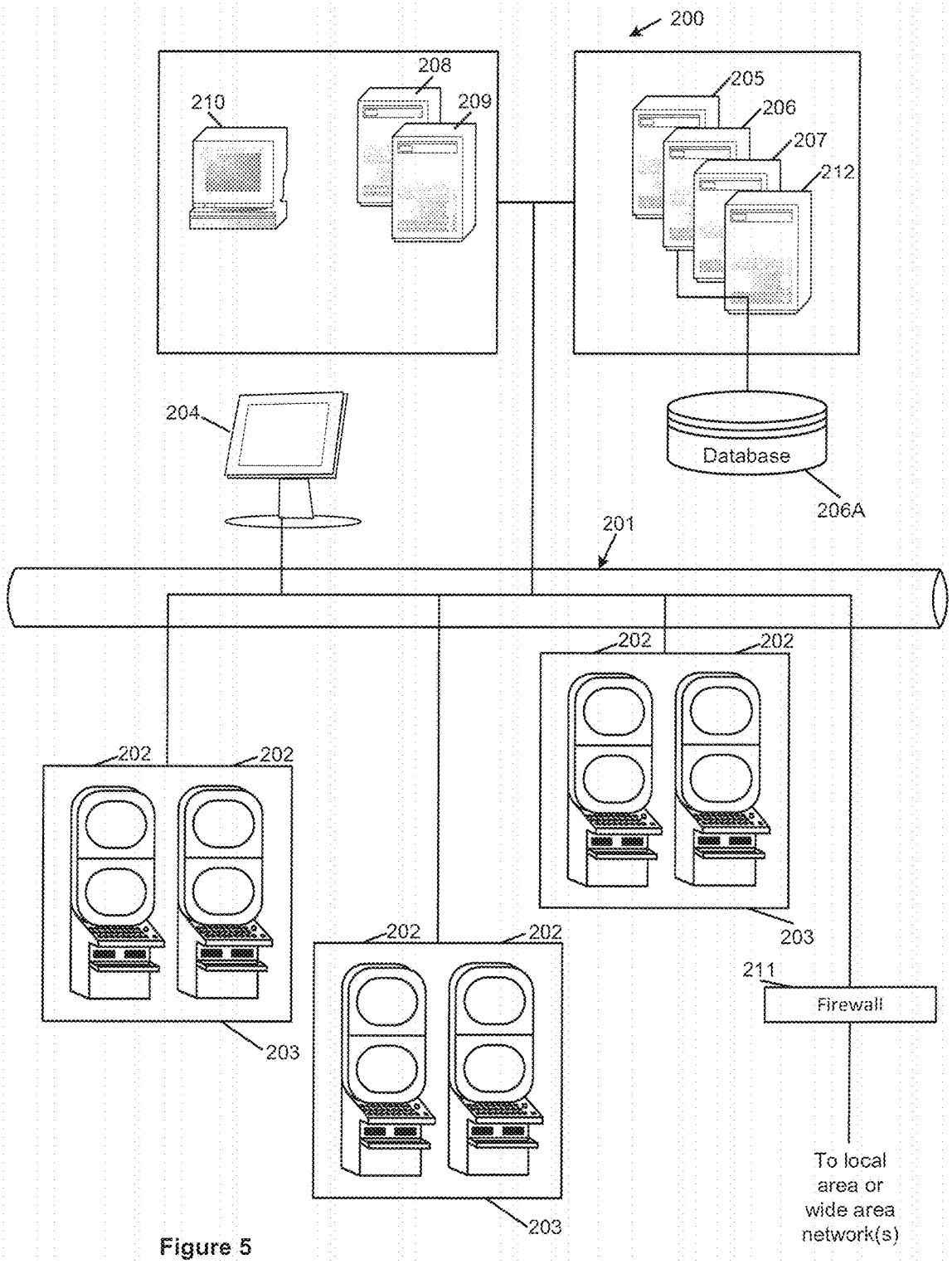
FIG. 5 is a schematic diagram of a network gaming system.

FIG. 5 shows a gaming system 200 in accordance with an alternative embodiment. The gaming system 200 includes a network 201, which for example may be an Ethernet network. The gaming system 200 can, for example, be used to provide online gaming over the Internet. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming Equipment

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Technologies Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

In other embodiments a player's win entitlement may be affected by purchasing access to particular pay tables—e.g. a first bet amount entitles the player to wins including cherries and a second amount entitles them to wins including plums.

Figure 6:
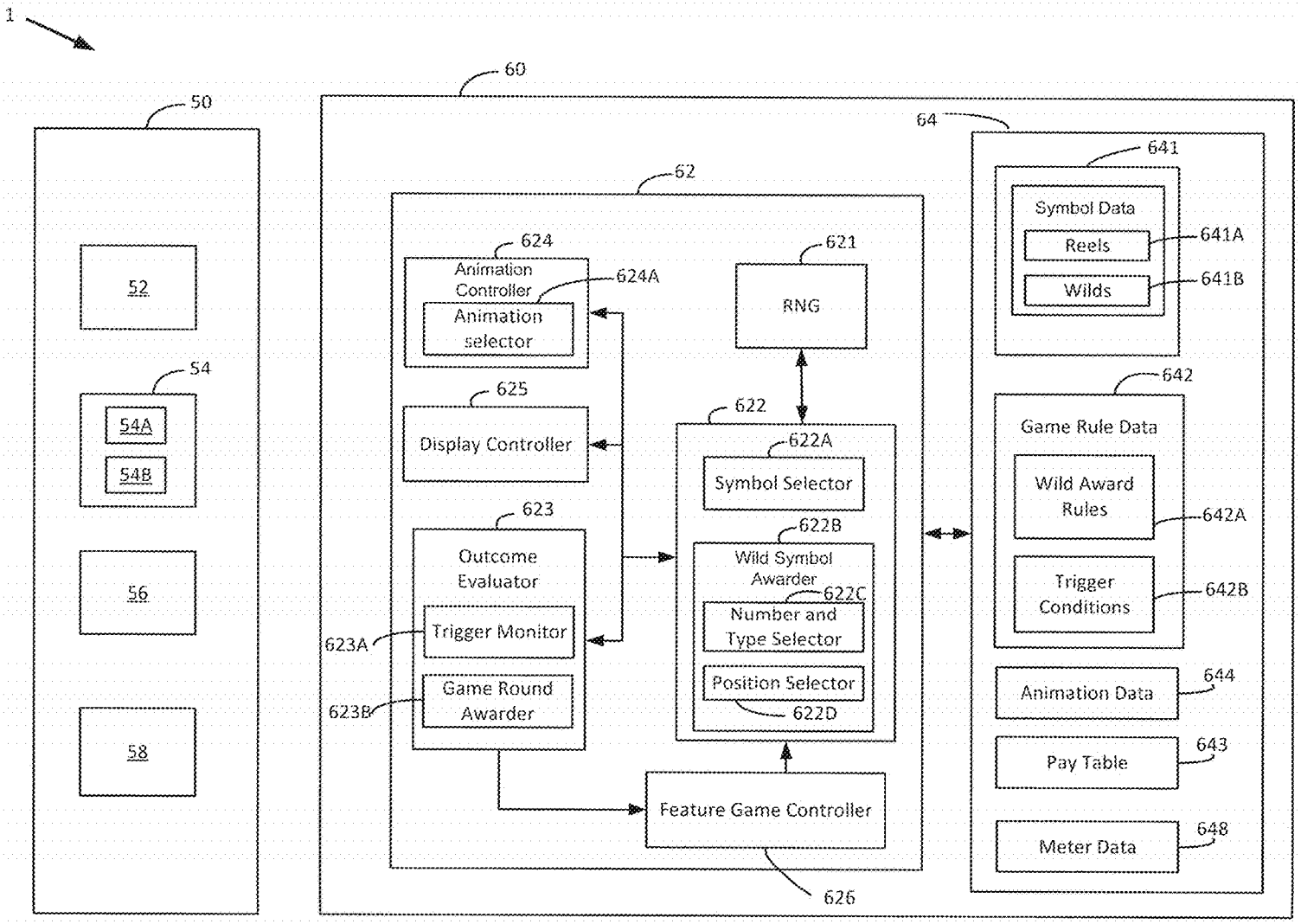
FIG. 6 is a further block diagram of a gaming system.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by award evaluator 623. The first part of forming the game outcome is for a symbol selector 622A to select symbols from a set of symbols specified by symbol data 641 using random number generator 621. The selected symbols are advised to the display controller 624 which causes them to be displayed on display 54 at a set of display positions.

One example of selecting symbols is for the symbol selector 622A to select symbols for display from a plurality of symbol sets corresponding to respective ones of a plurality of spinning reels. The symbol sets 641 can specify a sequence of symbols for each reel such that the symbol selector 622A can select all of the symbols by selecting a stopping position in the sequence. In one example, three symbols of each of five reels may be displayed such that symbols are displayed at fifteen display positions on display 54. It is known to use a probability table stored in memory 64 to vary the odds of a particular stop position being selected. Other techniques can be used to control the odds of particular outcomes occurring to thereby control the return to player of the game.

In some embodiments, an eligibility criteria may be applied, for example that the player has made a certain sized wager, made an ante bet, selected all win lines, played sufficient games, or the player is a member of a loyalty program.

The base game is a part of the game which is carried out each time the player makes a wager, typically irrespective of the wager, whereas other parts of the game will only be carried out occasionally for example if a condition is met such as a trigger occurring or if an ante bet is placed (depending on the specific embodiment).

Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

The trigger event may be, a symbol combination in the game, occurrence of a specific symbol in the game, purchased, be caused by another connected system, based on turnover, based on a random evaluation, etc.

A game round involves at least one of the reels being "spun"—e.g. new symbols of the reels are selected for display at the display positions and the reel is either physically or virtually spun to a stop. Persons skilled in the art will appreciate that there may be more than one game round in a play of a gaming machine such as is the case when a series of free spins is awarded. The outcome of a game round may be no win, a win (for example from a winning combination of symbols), a contribution towards a win accrued over a plurality of game rounds, a trigger condition occurring etc. Typically, a win will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Game Play Specifics

Figure 7:
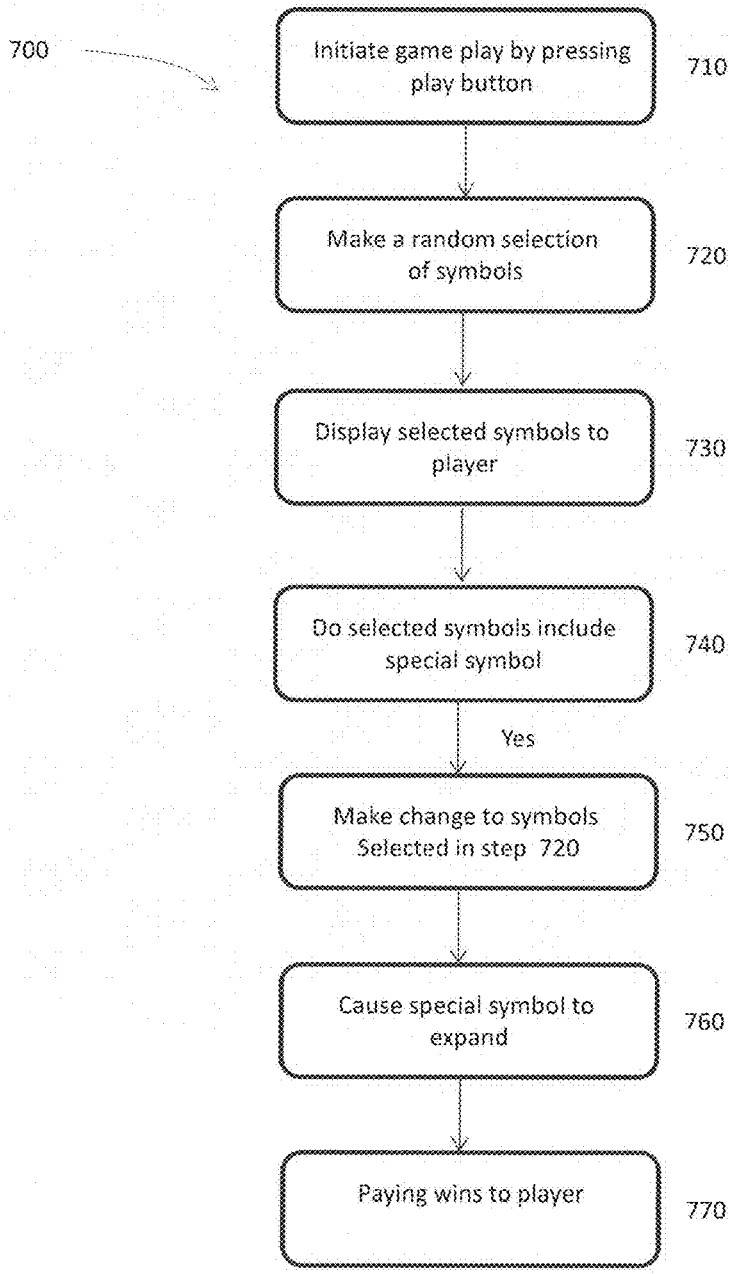
FIG. 7 is a flow chart of an embodiment.

With reference to FIG. 7, the game made available for play the aforementioned gaming equipment involves several steps 700. The player initiates the game play 710 by making a wager and pressing the "play" button, which is one of the buttons located in the button panel 22 (see FIG. 2). In response to initiating game play 710, the game controller 60 (see FIG. 1) performs the step 720 of making a random selection of game symbols, which define an outcome for that particular game play instance of the game. By generating the appropriate video signal the controller 60 then performs the step 730 of displaying the selected symbols to the player by causing the selected symbols to be displayed on the display 54 (see FIG. 1). More specifically and with reference to FIG. 8*a*, in displaying the selected symbols to the player the game controller 60 causes a number of spinning reels 82-90 to be displayed on the display 54. Each of the spinning reels 82-90 is associated with a number of symbols 92-120. In response to the player initiating the game play step 710, the reels 82-90 start spinning and after a period of time spinning (which is typically a few seconds) the reels 82-90 are caused to stop spinning and thereby reveal to the player the symbols 92-120 selected by the game controller 60 to form the game outcome. While the reels 82-90 are spinning the symbols 92-120 cannot be readily discerned by the player—it is only when the reels 82-90 stop spinning can the symbols 82-90 be discerned by the player.

Figure 8A:
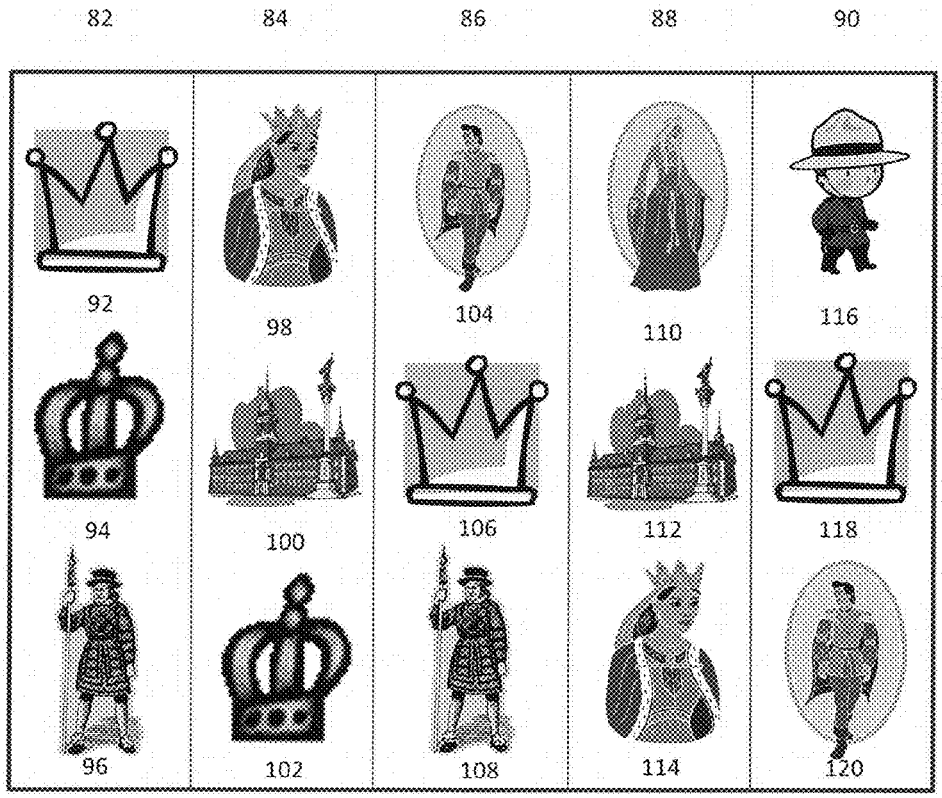
FIGS. 8*a*-8*d* are illustrations of game outcomes.

As can be seen in FIG. 8*a*, this particular embodiment contains five spinning reels 82-90. A consequence of using the arrangement of reels 82-90 is that the symbols 92-120 are arranged on the display 54 in a matrix defined by x rows and y columns. As illustrated in FIG. 8*a* there are three rows and five columns that make up the symbol matrix. Each reel 82-90 contains numerous different symbols 92-120. The majority of the symbols 92-120 are visually static and accordingly do not change in appearance while the game is being played. However, as described in more detail in the following paragraphs at least one of the reels 86 includes a special symbol 122 (see FIG. 8*b*) that is visually dynamic.

Figure 8B:
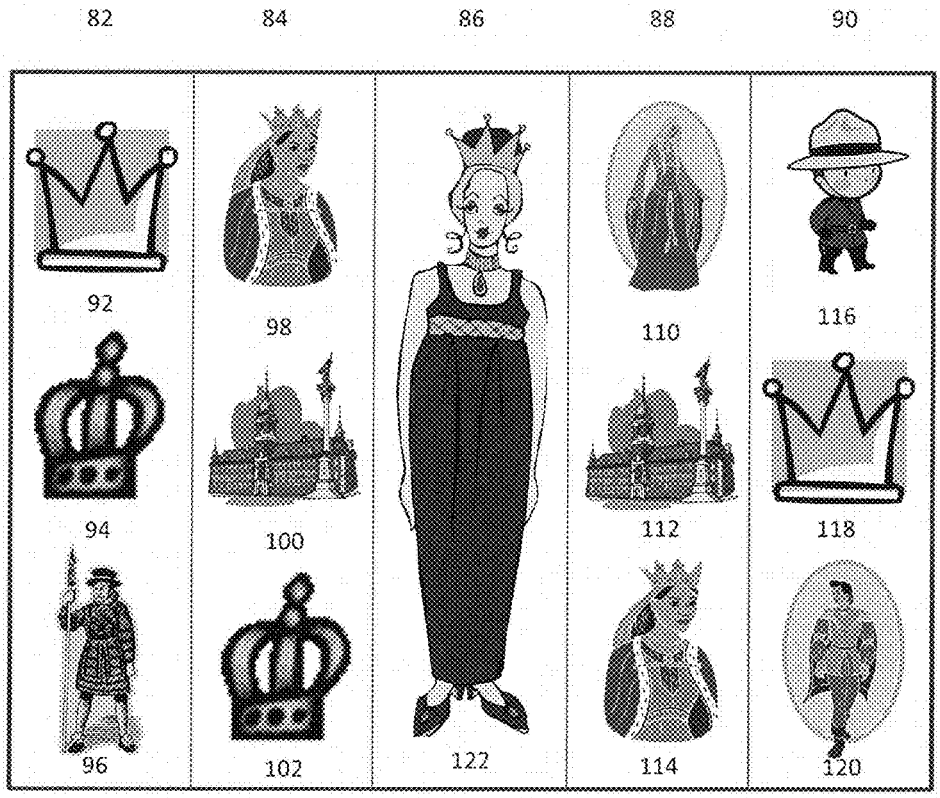

Referring again to FIG. 7, following the step 730 of causing the selected symbols to be displayed on the display 54 the game controller 60 performs the step 740 of determining whether the symbols selected in step 720 (i.e., the game outcome) include the special symbol 122. In this regard, the fact that the selected symbols include the special symbol 122 will be reflected in the symbols 92-120 displayed in step 730 in that at least one of the reels 86 will contain an oversized special symbol 122 (see FIG. 8*b*) that is discernibly larger than the other symbols 92-120 on the display 54. As can be seen in FIG. 8*b*, the oversized symbol 122 occupies more symbol positions on its respective reel 86 than any of the other symbols 92-120.

Figure 8C:
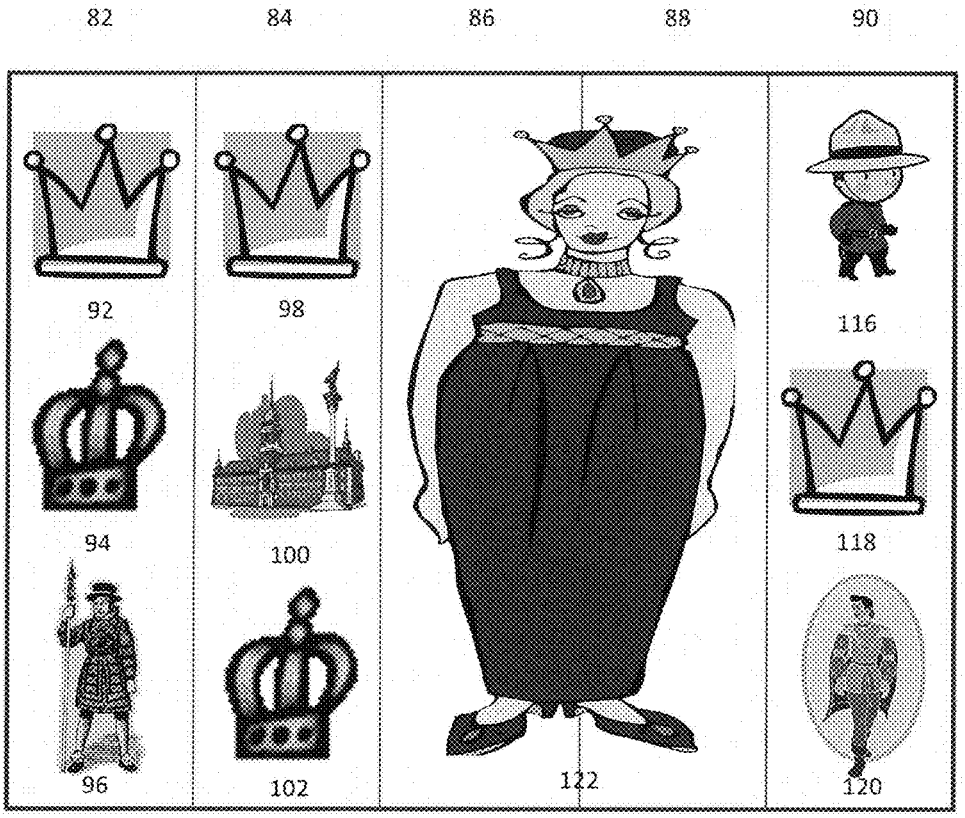
Figure 8D:
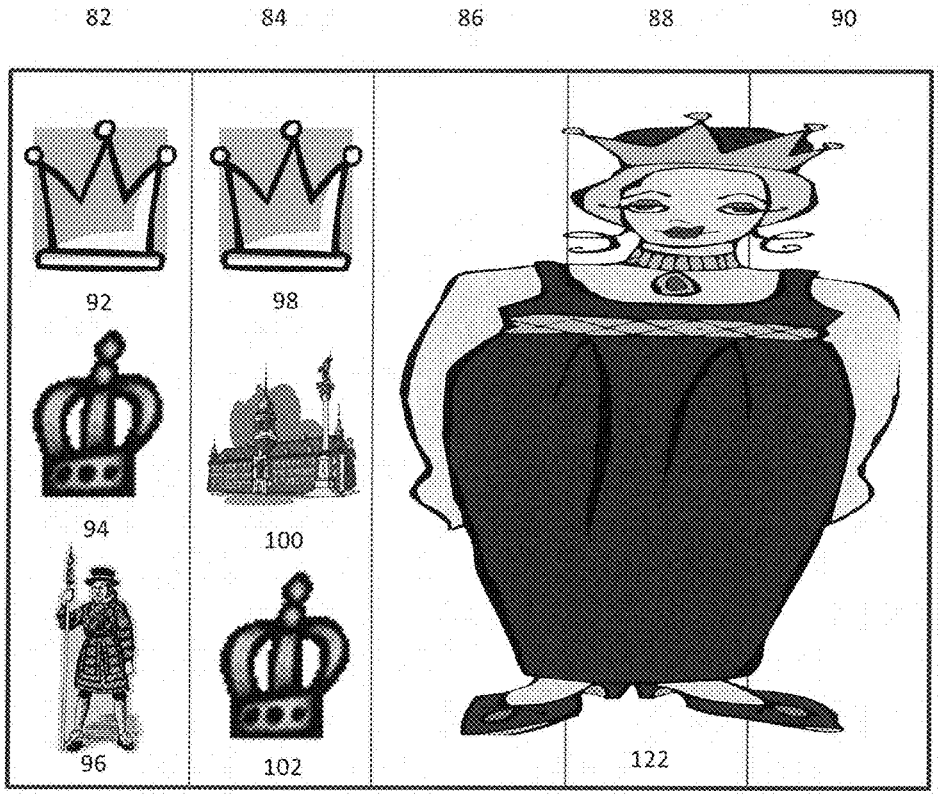

If as a consequence of the previous step 740 of determining that the selected symbols include the special symbol 122, the game controller 60 performs the step 750 of making a change to the selected symbols in order to change the selected symbols to a predefined winning combination of symbols. To convey the step 750 of changing the symbols to a player the game controller 60 carries out the step 760 of causing the oversized special symbol 122 to expand laterally so as to obscure the adjacent symbols 110 to 114 on the next reel 88. The oversized special symbol 122 can expand so as to spread across several of the reels 88 and 90 and not just one adjacent reel 88. It is envisaged that the oversized special symbol 122 can expand laterally in either the right or left direct, or indeed in both directions. The expanding of the special symbol 122 into an adjacent reel 88 is shown in FIG. 8*c*. In FIG. 8*d* the special symbol 122 is shown as expanding even further to replace the symbols 110-120 on two adjacent reels 88 and 90.

In this embodiment the special symbol 122 is considered a wild symbol and as persons skilled in the art will readily appreciate, a wild symbol acts as a substitute for all other symbols. As such, following the expansion of the special symbol 122 the game controller 60 will perform the step 770 of paying any wins to be payed to the player as a consequence of the other symbol 92-102 combinations will be enhanced by virtue of the special symbol. More specifically, the game described in this embodiment will pay the player a prize in response to the selected symbols comprising more than two of the crown symbols 92-98 (see FIG. 8*c*). Following the expansion of the special symbol 122 to cover both adjacent reels 88-90 the game will award the player for multiple combinations consisting of five of the crown symbols 92, 98 and the special symbol 122 because it is treated as the same crown symbols 92 and 98.

Within this embodiment it is envisioned that the special symbol 122 will only expand if a certain condition is met. More specifically, that condition is that as a result of expanding the player will be payed a prize. For example, as mentioned previously with reference to FIG. 8*c*, the player will be awarded a prize for a combination including two or more of the crown symbols 92 and 98. As a consequence of this, the special symbol 122 is caused to expand. However, if the player was not awarded a prize for the combination of two or more crown symbols 92 and 98 then the game controller 60 would not cause the special symbol 122 to expand. As persons skilled in the art will readily appreciate, triggering the expansion of the special symbol 122 is not restricted to whether or not a potential winning combination of symbols exist. An exemplary alternative trigger includes a random trigger in which the special symbol 122 is randomly triggered independently of the other symbols 92-120.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine, comprising:

a display device;

a credit input mechanism configured to receive a physical item associated with a monetary value and establish a credit balance based on said received physical item;

a player interface that enables a player to place a wager on a play of a game and to initiate the play of the game;

a game controller executing instructions from a memory which cause the game controller to at least:

display a plurality of display positions on the display device, the plurality of display positions arranged to form a plurality of rows and a plurality of columns;

select a plurality of symbols from a set of symbols to display in the plurality of display positions, the set of symbols including at least one expandable symbol and a plurality of non-expanding symbols;

determine that the selected plurality of symbols include at least one expandable symbol occupying one entire column of the plurality of columns;

determine that a first symbol combination comprising the at least one expandable symbol occupying one entire column and a plurality of the non-expanding symbols displayed in the plurality of display positions forms a first outcome;

in response to determining that the first symbol combination forms the first outcome, further determine if expanding the expandable symbol into at least one other display position of the plurality of display positions adjacent to the one entire column results in a second outcome;

in response to determining that expanding the expandable symbol results in the second outcome, cause the expandable symbol to expand in size so as to replace a symbol displayed at the at least one other display position of the plurality of display positions adjacent to the one entire column, wherein the second outcome is a winning outcome formed by a second symbol combination of the expanded symbol and one or more of the plurality of non-expanding symbols;

adjust the credit balance based at least in part on an amount associated with the first outcome and an amount associated with the second outcome; and a payout mechanism configured to dispense a payout of the credit balance from the gaming machine.

2. The gaming machine of claim 1, wherein the first outcome is a first win.

3. The gaming machine of claim 1, wherein the at least one expandable symbol is predetermined to be expandable in size.

4. The gaming machine of claim 1, wherein the plurality of non-expanding symbols are predetermined to be non-expandable in size.

5. The gaming machine of claim 1, wherein the one entire column is a predetermined column, and wherein the game controller is further configured to expand the expandable symbol such that the expanded symbol is positioned in at least the predetermined column and the at least one other display position of the plurality of display positions adjacent to the one entire column.

6. The gaming machine of claim 5, wherein the at least one other display position of the plurality of display positions adjacent to the one entire column is one or more adjacent columns.

7. The gaming machine of claim 6, wherein the expanded symbol is positioned in at least two of the one or more adjacent columns.

8. The gaming machine of claim 6, wherein the one or more adjacent columns is located on a right side of the predetermined column.

9. The gaming machine of claim 1, wherein the display device depicts:

the plurality of symbols as being associated with a plurality of spinning reels;

the at least one expandable symbol as initially being located on only one of the spinning reels; and the expanded symbol on at least two of the plurality spinning reels subsequent to expanding the at least one expandable symbol.

10. The gaming machine of claim 9, wherein the expanded symbol occupies at least two of the plurality of spinning reels.

11. A method of operating a gaming machine comprising a display device; a credit input mechanism configured to receive a physical item associated with a monetary value and establish a credit balance based on said received physical item; a player interface that enables a player to place a wager on a play of a game and to initiate the play of the game; a game controller executing instructions from a memory; and, a payout mechanism, the method comprising:

displaying, by the game controller, a plurality of display positions on the display device, the plurality of display positions arranged to form a plurality of rows and a plurality of columns;

selecting, by the game controller, a plurality of symbols from a set of symbols to display in the plurality of display positions, the set of symbols including at least one expandable symbol and a plurality of non-expanding symbols;

determining, by the game controller, that the selected plurality of symbols include at least one expandable symbol occupying one entire column of the plurality of columns;

determining, by the game controller, that a first symbol combination comprising the at least one expandable symbol occupying one entire column and a plurality of the non-expanding symbols displayed in the plurality of display positions forms a first outcome;

determining, by the game controller, if expanding the expandable symbol into at least one other display position of the plurality of display positions adjacent to the one entire column results in a second outcome in response to the first outcome;

causing, by the game controller, the expandable symbol to expand in size so as to replace a symbol displayed at the at least one other display position of the plurality of display positions adjacent to the one entire column in response to the second outcome being a winning outcome formed by a second symbol combination of the expanded symbol and one or more of the plurality of non-expanding symbols;

adjusting, by the game controller, the credit balance based at least in part on an amount associated with the first outcome and an amount associated with the second outcome; and dispensing, via the payout mechanism, a payout of the credit balance from the gaming machine.

12. The method of claim 11, wherein the first outcome is a first win.

13. The method of claim 11, wherein the at least one expandable symbol is predetermined to be expandable in size.

14. The method of claim 11, wherein the plurality of non-expanding symbols are predetermined to be non-expandable in size.

15. The method of claim 11, wherein the one entire column is a predetermined column, and comprising expanding, by the game controller, the expandable symbol such that the expanded symbol is positioned in at least the predetermined column and the at least one other display position of the plurality of display positions adjacent to the one entire column.

16. The method of claim 15, wherein the at least one other display position of the plurality of display positions adjacent to the one entire column is one or more adjacent columns.

17. The method of claim 16, wherein the expanded symbol is positioned in at least two of the one or more adjacent columns.

18. The method of claim 16, wherein the one or more adjacent columns is located on a right side of the predetermined column.

19. The method of claim 11, comprising depicting, by the display device, at least:

the plurality of symbols as being associated with a plurality of spinning reels;

the at least one expandable symbol as initially being located on only one of the spinning reels; and the expanded symbol on at least two of the plurality spinning reels subsequent to expanding the at least one expandable symbol.

20. The method of claim 19, wherein the expanded symbol occupies at least two of the plurality of spinning reels.

* * * * *